US010210792B2

(12) United States Patent
Drzaic

(10) Patent No.: US 10,210,792 B2
(45) **Date of Patent: *Feb. 19, 2019**

(54) SYSTEMS AND METHODS FOR CONTROLLING CURRENT IN DISPLAY DEVICES

(71) Applicant: Apple Inc., Cupertino, CA (US)

(72) Inventor: Paul S. Drzaic, Morgan Hill, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/606,581

(22) Filed: May 26, 2017

(65) Prior Publication Data

US 2017/0337868 A1 Nov. 23, 2017

Related U.S. Application Data

(63) Continuation of application No. 13/599,863, filed on Aug. 30, 2012, now Pat. No. 9,666,119.

(51) Int. Cl.
*G09G 3/30* (2006.01)
*G09G 3/3283* (2016.01)

(52) U.S. Cl.
CPC ..... *G09G 3/30* (2013.01); *G09G 3/3283* (2013.01); *G09G 2320/0613* (2013.01); *G09G 2320/0686* (2013.01); *G09G 2330/021* (2013.01); *G09G 2360/144* (2013.01)

(58) Field of Classification Search
CPC ... G09G 2320/0613; G09G 2320/0686; G09G 2330/021; G09G 2360/144; G09G 3/30; G09G 3/3283
See application file for complete search history.

(56) References Cited

U.S. PATENT DOCUMENTS

| | | | |
|---|---|---|---|
| 7,504,612 | B2 | 3/2009 | Yu et al. |
| 7,619,598 | B2 | 11/2009 | Pulvirenti et al. |
| 7,800,559 | B2 | 9/2010 | Weibruch et al. |
| 8,836,635 | B2 | 9/2014 | Mori et al. |
| 8,836,734 | B2 | 9/2014 | Mori et al. |
| 8,902,132 | B2 | 12/2014 | Ozawa et al. |
| 2006/0001624 | A1 | 1/2006 | Lee |
| 2006/0001660 | A1 | 1/2006 | Plut |

(Continued)

FOREIGN PATENT DOCUMENTS

| | | | |
|---|---|---|---|
| JP | 2007156045 | A | 6/2007 |
| JP | 2008249745 | A | 10/2008 |

(Continued)

*Primary Examiner* — Richard Hong
(74) *Attorney, Agent, or Firm* — Fletcher Yoder PC

(57) ABSTRACT

The present disclosure relates generally systems and methods for controlling current provided to display devices. A method for controlling the current may include receiving drive current values associated with subpixels in a display and receiving information that corresponds to an application type being rendered on the display and/or an indication of image data being rendered on the display. The method may then include reducing at least some of the drive current values based at least in part on the application type. Alternatively, the method may include reducing the at least a portion of the image data corresponding to the at least some of the drive current values has substantially similar luminance and color values. The method may then include supplying the subpixels with drive currents that correspond to the drive current values.

20 Claims, 6 Drawing Sheets

(56) References Cited

U.S. PATENT DOCUMENTS

| | | | |
|---|---|---|---|
| 2006/0262147 | A1 | 11/2006 | Kimpe et al. |
| 2007/0081720 | A1 | 4/2007 | Ok et al. |
| 2007/0139437 | A1 | 6/2007 | Boroson et al. |
| 2007/0146252 | A1 | 6/2007 | Miller |
| 2007/0176859 | A1 | 8/2007 | Cok |
| 2007/0257944 | A1 | 11/2007 | Miller et al. |
| 2008/0204384 | A1 | 8/2008 | Lee et al. |
| 2008/0204438 | A1 | 8/2008 | Song |
| 2008/0238566 | A1 | 10/2008 | Bhowmik |
| 2008/0303918 | A1 | 12/2008 | Keithley |
| 2009/0278774 | A1 | 11/2009 | Chen et al. |
| 2010/0174930 | A1 | 7/2010 | Kim et al. |
| 2010/0201275 | A1 | 8/2010 | Cok et al. |
| 2010/0231616 | A1 | 9/2010 | Park et al. |
| 2011/0109661 | A1 | 5/2011 | Lee |
| 2011/0115835 | A1 | 5/2011 | Lee |
| 2011/0221720 | A1 | 9/2011 | Kuo et al. |
| 2011/0234643 | A1 | 9/2011 | Park et al. |
| 2012/0019506 | A1 | 1/2012 | Hekstra et al. |
| 2013/0082589 | A1 | 4/2013 | Haas |
| 2013/0093799 | A1 | 4/2013 | Choi et al. |

FOREIGN PATENT DOCUMENTS

| | | | |
|---|---|---|---|
| KR | 10-2010-0104014 | A1 | 9/2010 |
| TW | 2010030714 | A | 8/2010 |
| TW | 2010030715 | A | 8/2010 |
| TW | 201214397 | A | 4/2012 |
| WO | 2012015601 | A1 | 2/2012 |

SYSTEMS AND METHODS FOR CONTROLLING CURRENT IN DISPLAY DEVICES

CROSS-REFERENCE TO RELATED APPLICATIONS

This application is a continuation of and claims priority to U.S. patent application Ser. No. 13/599,863, filed on Aug. 30, 2012 and entitled "SYSTEMS AND METHODS FOR CONTROLLING CURRENT IN DISPLAY DEVICES," which is incorporated by reference herein in its entirety for all purposes.

BACKGROUND

The present disclosure relates generally to power efficient display devices and, more specifically, to automatic current limit (ACL) control that reduces an overall power consumption in organic light emitting diode (OLED) display devices.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Organic light emitting diode (OLED) display devices generate light in response to an electronic signal, such that an OLED display device generates a brighter light in response to a larger electronic signal (e.g., current). As such, the OLED display consumes a high amount of power when rendering bright images on the OLED display. Similarly, the OLED display also consumes a high amount of power when rendering images with a high proportion of white pixels (e.g., mimicking the appearance of a book page or a sheet in a word processing document) or when raising an overall luminance of the OLED display in order to improve viewing in bright environments. In addition to being an inefficient use of power, this use of high power in OLED displays can be detrimental to the performance of the OLED displays. For instance, the high power use reduces battery life and can lead to problems with thermal heating of the electronic device attached to the OLED display.

Although the conventional automatic current limit (ACL) circuits may provide some power savings in OLED displays, the resulting image rendered by the display device may be objectionable to a viewer. For example, in a photographic image, or an application that relies on realistic rendering of the colors and luminance levels of an image, the application of the conventional ACL approach may reduce the overall luminance of the displayed image making it difficult to discern subtle differences in colors of the displayed image, and reducing the quality of the image rendered on the OLED display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to a control system that may reduce the drive current provided to each subpixel or to a number of specified subpixels of the display based on various factors related to the image(s) being displayed. In this manner, the control system may provide significant power savings while maintaining the quality of the displayed images. Moreover, the reduction in power can lead to improved lifetime of the displays, and reduce the heat generated by the display during operation. In one embodiment, the control system may receive information that indicate a type of application rendering images on the display, a type image being rendered by the display, an amount of power being consumed by the display, an amount of ambient light level reflecting off the display, or the like. After receiving this information, the control system may determine a degree of current reduction for each subpixel of the display based on these inputs.

For instance, in one embodiment, the control system may analyze the application being rendered on the display. If the application displays a large amount of white content (e.g., email, electronic book/reader, word processing, and spreadsheets), the control system may reduce the current available to drive the display uniformly because the overall reduction of white levels in the background should not detract from the quality of the images of text displayed by the application. Alternatively, if the application is designed to display accurate colors (e.g., viewing photographic or video content), the control system may not reduce the current available to drive the display in order to maintain the integrity of images being displayed.

In another embodiment, the control system may analyze an image being displayed and identify subpixels in the image that are substantially similar. The control system may then reduce the current available to drive the substantially similar subpixels while maintaining the current available to drive the subpixels that are not substantially similar.

In yet another embodiment, the control system may measure a signal representative of the amount of ambient light reflecting off the display. The control system may then modify the extent in which the current being applied to the display is reduced based on the measured ambient light level. For instance, the control system may restrict the current driving the display less in bright environments as compared to in dark environments. By reducing the current available to drive certain pixels, the control system may reduce the luminance or certain aspects of the image such that the rendered image may be more acceptable to a viewer. Accordingly, the control system may be useful for reducing the power consumed by the display in ways that do not render the depicted images objectionable to the viewer.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to systems, displays, and methods for reducing drive currents provided to an electronic display to improve the power efficiency and/or the appearance of the display. Organic Light Emitting Diode (OLED) displays may use an array of OLEDs to show an image across the display. Each OLED subpixel emits light of a certain color and brightness based on drive currents provided to the OLEDs. In one embodiment, red, green, and blue emitters may be used to display a range of colors. In another embodiment, the OLED display may emit white light, and color filters or fluorescent materials may be used to convert the white light into individual colors. The emitted colors may be red, green, and blue, but an additional white subpixel may also be used. In yet another embodiment, red, green, and blue emitters may be used to emit a range of colors, and these colors may be further refined by passage through a set of color filters such that each emitting color is paired with a particular color of color filter.

The drive currents provided to each OLED subpixel may be regulated by an Automatic Current Limit (ACL) controller in a display driver. The ACL controller may reduce the power consumption of the OLED display by reducing the total drive current provided to the OLED display or by restricting the current to all OLED subpixels in a proportional manner. However, instead of uniformly reducing the drive current provided to each OLED irrespective of the image being displayed and/or the viewing conditions, the ACL controller may reduce the drive current provided to each OLED subpixel or to specified OLED subpixels in a manner that provides power savings while maintaining the integrity of images depicted on the OLED display.

Figure 1:
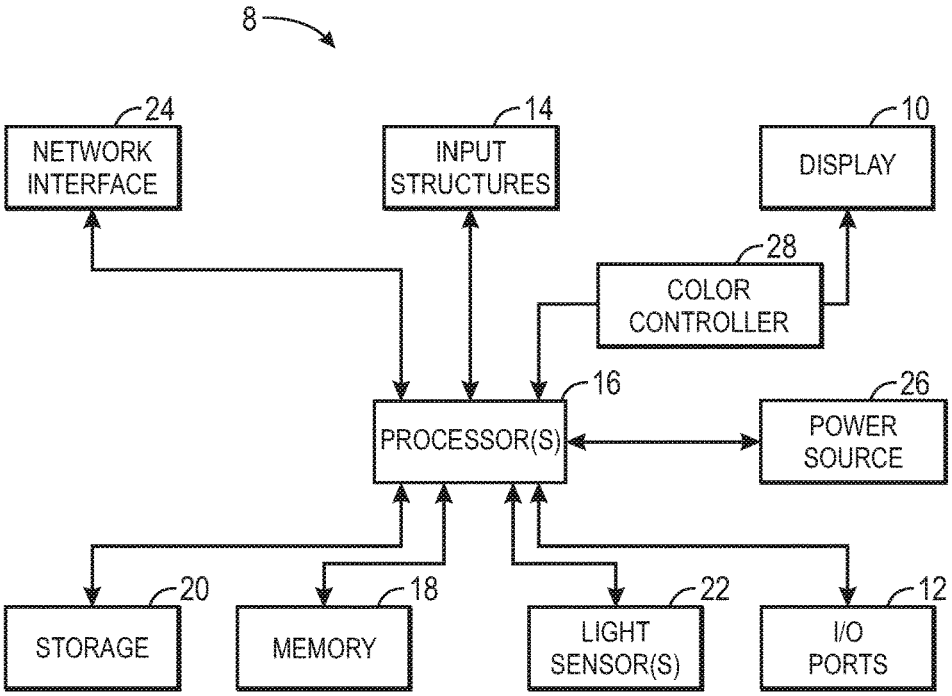
FIG. 1 is a block diagram of components of an electronic device, in accordance with an embodiment.

A variety of electronic devices may incorporate the OLED displays having the ACL controller. An example of a suitable electronic device may include various internal and/or external components, which contribute to the function of the device. FIG. 1 is a block diagram illustrating the components that may be present in such an electronic device 8 and which may allow the device 8 to function in accordance with the techniques discussed herein. Those of ordinary skill in the art will appreciate that the various functional blocks shown in FIG. 1 may comprise hardware elements (including circuitry), software elements (including computer code stored on a computer-readable medium) or a combination of both hardware and software elements. It should further be noted that FIG. 1 is merely one example of a particular implementation and is merely intended to illustrate the types of components that may be present in a device 8. For example, in the presently illustrated embodiment, these components may include a display 10, I/O ports 12, input structures 14, one or more processors 16, a memory device 18, a non-volatile storage 20, one or more light sensors 22, a networking device 24, a power source 26, and an Automatic Current Limiter (ACL) 28.

With regard to each of these components, the display 10 may be used to display various images generated by the device 8. In one embodiment, the display 10 may be an organic light emitting diode (OLED) display. An OLED display may include a number of pixels or picture elements that may be used to depict images on the display 10. In an OLED display, each pixel may be composed of three pixel components, known as subpixels, that may depict red, green, and blue colors, respectively. Alternatively, four pixel components, namely red, green, blue, and white may be employed. Each OLED subpixel may depict is respective color using an emissive electroluminescent layer (i.e., film of organic compound) which emits light in response to an electric current. The color of the light viewed may be the light emitted directly by the OLED subpixels, or the color altered by passage through a color filter containing an absorbing or a fluorescing material. As such, when bright images are rendered on an OLED display, relatively high levels of power may be used by the display 10.

The I/O ports 12 may include ports configured to connect to a variety of external devices, such as a power source, headset or headphones, or other electronic devices 8 (such as handheld devices and/or computers, printers, projectors, external displays, modems, docking stations, and so forth). The input structures 14 may include the various devices, circuitry, and pathways by which user input or feedback is provided to the processor 16. The input structures 14 may be configured to control a function of the device 8, applications running on the device 8, and/or any interfaces or devices connected to or used by the electronic device 8.

The processor(s) 16 may provide the processing capability to execute the operating system, programs, user and application interfaces, and any other functions of the electronic device 8. The instructions or data to be processed by the processor(s) 16 may be stored in a computer-readable medium, such as the memory 18. The memory 18 may be provided as a volatile memory, such as random access memory (RAM), and/or as a non-volatile memory, such as read-only memory (ROM). The components may further include other forms of computer-readable media, such as a non-volatile storage 20, for persistent storage of data and/or instructions. The non-volatile storage 20 may include flash memory, a hard drive, or any other optical, magnetic, and/or solid-state storage media. The non-volatile storage 20 may be used to store firmware, data files, software, wireless connection information, and any other suitable data.

The embodiment illustrated in FIG. 1 may also include one or more light sensors 22. The light sensors 22 may include sensors such as photodetectors, photo diodes, photo resistors, photocells, or any other sensor capable of detecting ambient light. 0In various embodiments, the light sensors 22 may be disposed in the substrate such that they receive light from the direction of the substrate, the direction opposite the substrate, or both. In certain embodiments, a camera may be present in the device and may serve as a light sensor.

The components depicted in FIG. 1 also include a network device 24, such as a network controller or a network interface card (NIC). The network device 24 may be a Wi-Fi device, a radio frequency device, a Bluetooth® device, a cellular communication device, or the like. The network device 24 may allow the electronic device 8 to communicate over a network, such as a Local Area Network (LAN), Wide Area Network (WAN), or the Internet. Further, the components may also include a power source 26 such a battery or AC power.

To prevent excessive power consumption by the display 10, the electronic device 8 may also include the Automatic Current Limiter (ACL) 28. The ACL 28 may monitor the overall power or current used by the display 10, and reduce overall power consumption in the display 10 by controlling the current provided to the display 10. In one embodiment, the ACL 28 may estimate the power consumption expected for an image frame that is to be displayed on display 10. The ACL 28 may limit the drive current provided to each subpixel of the display 10 based on various factors. Additional details with regard to the ACL 28 will be discussed below with reference to FIGS. 4-11.

Figure 2:
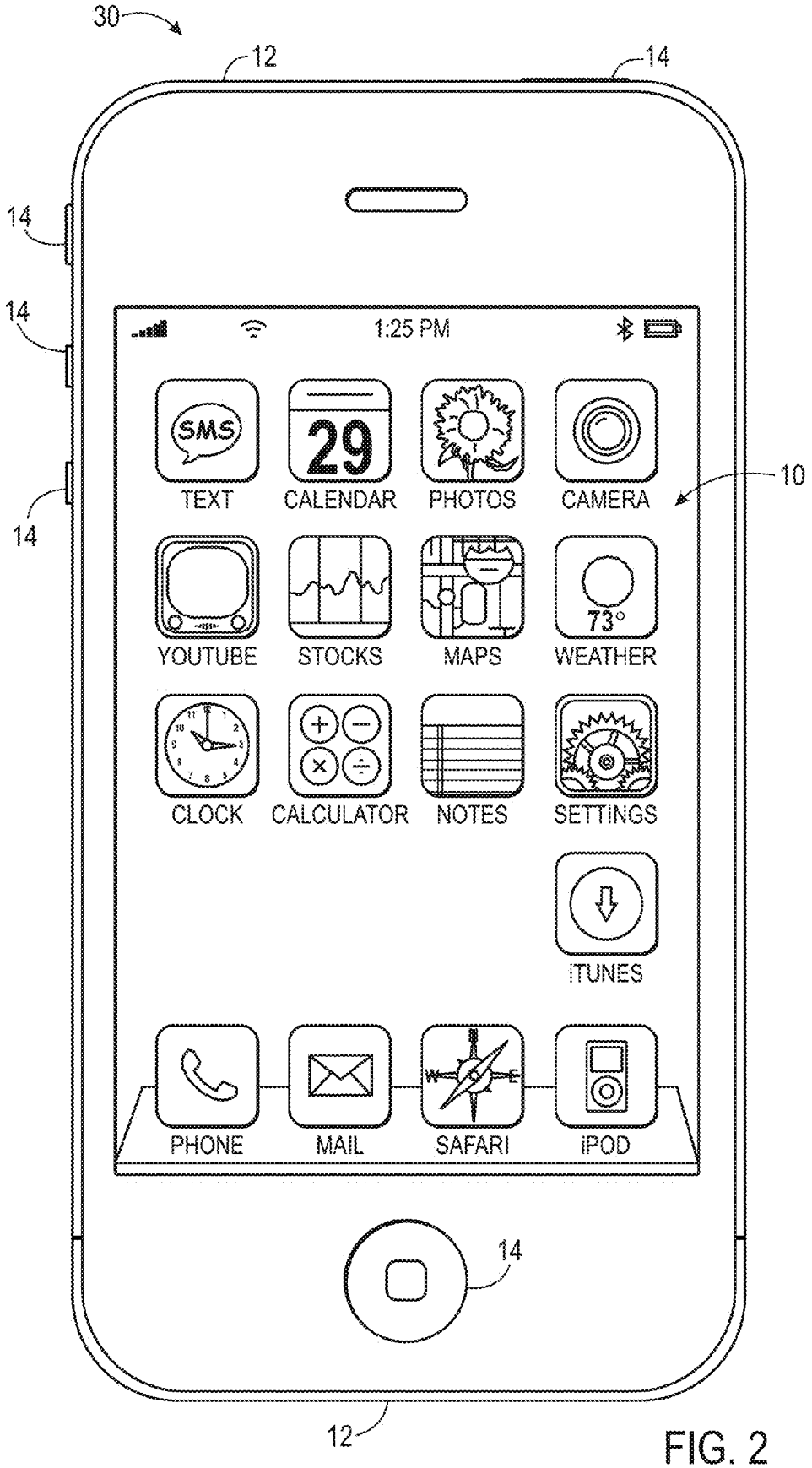
FIG. 2 is a front view of a handheld electronic device in accordance with an embodiment.

With the foregoing in mind, FIG. 2 illustrates an electronic device 8 in the form of a handheld device 30, here a cellular telephone. It should be noted that while the depicted handheld device 30 is provided in the context of a cellular telephone, other types of handheld devices (such as media players for playing music and/or video, personal data organizers, handheld game platforms, and/or combinations of such devices) may also be suitably provided as the electronic device 8. As discussed with respect to the general electronic device 8 of FIG. 1, the handheld device 30 may allow a user to connect to and communicate through the Internet or through other networks, such as local or wide area networks. The handheld electronic device 30, may also communicate with other devices using short-range connections, such as Bluetooth and near field communication. By way of example, the handheld device 30 may be a model of an iPod®, iPad®, or iPhone® available from Apple Inc. of Cupertino, Calif.

The handheld device 30 includes a display 10 in the form of an OLED display. The display 10 may be used to display a graphical user interface (GUI) that allows a user to interact with the handheld device 30. The handheld electronic device 30 also may include various input and output (I/O) ports 12 that allow connection of the handheld device 30 to external devices such as a port that allows the transmission and reception of data or commands between the handheld electronic device 30 and another electronic device.

Figure 3:
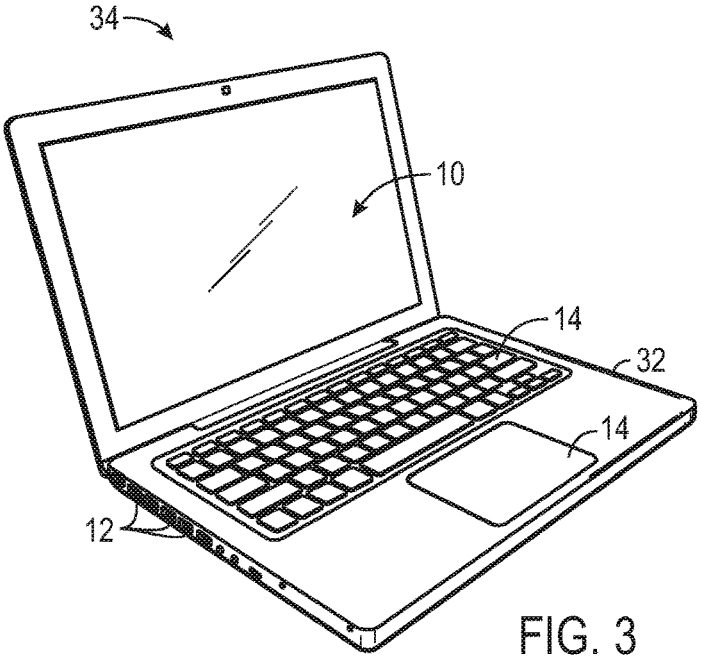
FIG. 3 is a view of a computer in accordance with an embodiment.

In addition to handheld devices 30, such as the depicted cellular telephone of FIG. 2, an electronic device 8 may also take the form of a computer or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 8 in the form of a computer may be a model of a MacBook®, MacBook® Pro, MacBook Air®, iMac®, Mac® mini, iPad® or Mac Pro® available from Apple Inc. By way of example, an electronic device 8 in the form of a laptop computer 34 is illustrated in FIG. 3 in accordance with one embodiment. The depicted computer 34 includes a housing 32, a display 10 (such as an OLED display), input structures 14, and input/output ports 12.

In one embodiment, the input structures 14 (such as a keyboard and/or touchpad) may be used to interact with the computer 34, such as to start, control, or operate a GUI or applications running on the computer 34. For example, a keyboard and/or touchpad may allow a user to navigate a user interface or application interface displayed on the display 10.

As depicted, the electronic device 8 in the form of computer 34 may also include various input and output ports 12 to allow connection of additional devices. For example, the computer 34 may include an I/O port 12, such as a USB port or other port, suitable for connecting to another electronic device, a projector, a supplemental display, and so forth. In addition, the computer 34 may include network connectivity, memory, and storage capabilities, as described with respect to FIG. 1. As a result, the computer 34 may store and execute a GUI and other applications.

With the foregoing discussion in mind, it may be appreciated that an electronic device 8 in the form of either a handheld device 30 or a computer 34 may be provided with an OLED display as the display 10. Such an OLED display may be utilized to display the respective operating system and application interfaces running on the electronic device 8 and/or to display data, images, or other visual outputs associated with an operation of the electronic device 8.

In embodiments in which the electronic device 8 includes an OLED display, the display 10 may employ inorganic light emitting diodes or organic light emitting diodes (OLEDs) as the display 10. The OLED display may include a number of pixels that may be composed of red, green, and blue subpixels. The OLED display may generate light in response to an electronic signal. As such, when bright images are shown on the OLED display, relatively high levels of power may be used for displaying images.

Figure 4:
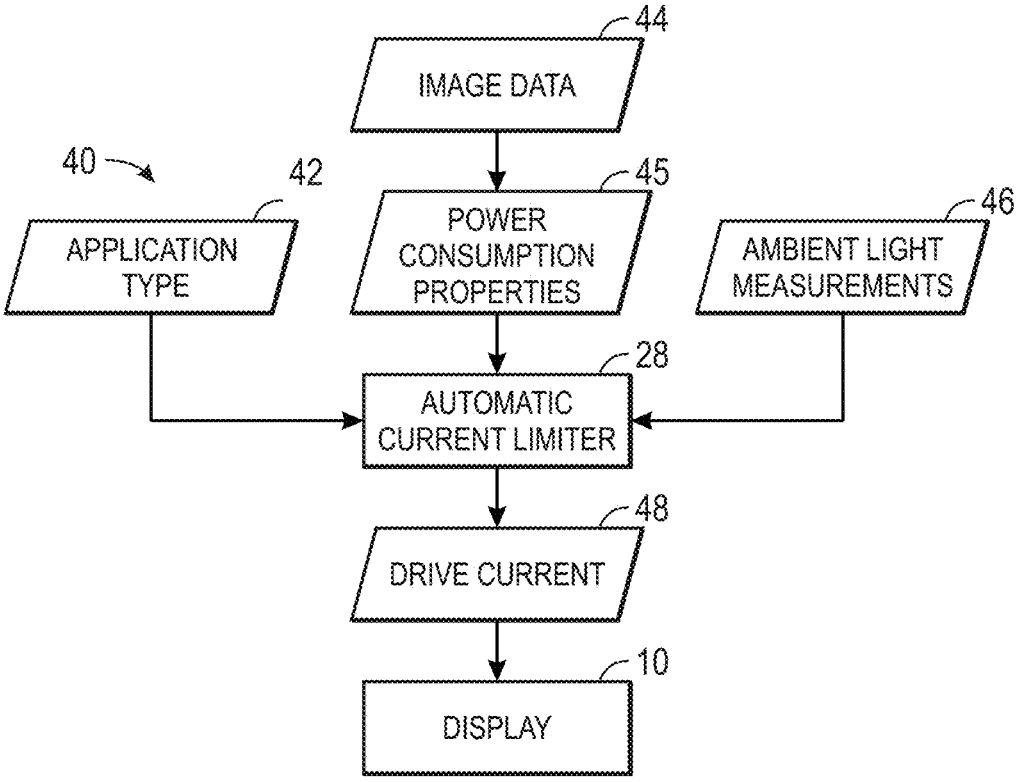
FIG. 4 is a data flow diagram that depicts inputs that an automatic current limit (ACL) controller may use for determining drive currents for a display, in accordance with an embodiment.

Keeping the foregoing in mind, FIG. 4 illustrates a data flow diagram 40 that depicts inputs that the ACL 28 may use to determine drive currents for each subpixel in the display 10 to enable the display 10 to conserve power while maintaining the integrity of the images depicted therein. In one embodiment, the ACL 28 may receive information related to a type of application being rendered by the display 10 (i.e., application type 42), an image to be depicted on the display 10 (i.e., image data 44), power consumption properties 45 of the display 10, ambient light measurements 46, and the like. Based on the application type 42, the image data 44, the power consumption properties 45, and/or the ambient light measurements 46, the ACL 28 may determine a drive current 48 for each subpixel in the display 10 during each frame of displayed data. As mentioned above, the drive current 48 for each subpixel may be calculated such that the display 10 conserves power while maintaining the quality of the images depicted therein. After determining the drive current 48 for each subpixel in the display 10 during each frame of displayed data, the ACL 28 may provide each respective subpixel in the display 10 with a respective drive current 48, thereby enabling the display 10 to consume power efficiently. Additional details describing how the ACL 28 may determine the drive current 48 for each subpixel in the display 10 during each frame of the displayed data are provided below with reference to FIGS. 5-10.

Figure 5:
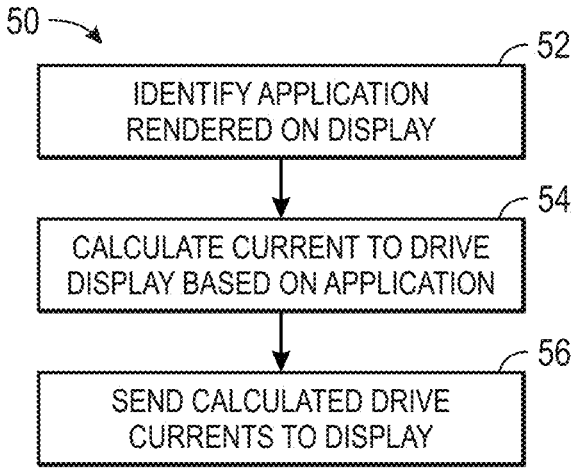
FIG. 5 is a flow chart that depicts a method for reducing an amount of drive currents sent to a display based on an application being rendered on the display, in accordance with an embodiment.

Referring now to FIG. 5, the ACL 28 may employ a method 50 to determine the drive current 48 for each subpixel in the display 10 based on the application type 42 being displayed. At block 52, the ACL 28 may identify the application or program (i.e., application type 42) being rendered by the display 10. In general, the ACL 28 may determine whether the application type 42 corresponds to an application directed towards displaying text for reading, images for viewing, or both. In some embodiments, different applications or programs may be in operation at the same time on a device, visible in different windows on the display. In this case, the ACL 28 may decide whether to apply a different drive current for the images depicted in each displayed window, or whether to apply a relatively uniform reduction in drive current across all of the displayed windows.

At block 54, the ACL 28 may calculate the drive current 48 that may be used to drive each subpixel in the display 10 based on the application identified at block 52 (i.e., application type 42). In one embodiment, the calculated drive current may be optimized to conserve power usage with respect to the display 10 while maintaining the integrity and quality of the images being rendered on the display 10. For example, at block 52, the ACL 28 may identify an application type 42 that corresponds to an application directed towards displaying text for reading. In this case, at block 54, the ACL 28 may calculate drive currents 48 that may reduce the power being consumed by the display 10 while maintaining the quality or readability of the text being depicted on the display 10. Examples of text rendering applications may include a word processing application, a spreadsheet application, an electronic mail (email) application, an electronic reader application, and the like.

In general, text-rendering applications may display image data that have black text along a white background. To create a white color for the white background, a high amount of current may be provided to each subpixel in the display 10 that corresponds to the white background. To provide for more energy efficient displays, at block 54, the ACL 28 may calculate a reduced drive current for each subpixel in the display 10 based on the amount of white background being displayed. In this manner, the overall white level of the white background may be reduced while the black level of the text being displayed in the display 10 may remain relatively the same since achieving black levels in OLED subpixels uses little or no current. Further, the reduction in the overall white level of the background should not detract greatly from the readability of the text being displayed so long as a sufficient amount of contrast exists between the text and the background due to the Bartleson-Breneman effect. The Bartleson-Breneman effect generally states that an image with very high contrast will actually appear brighter than an image of the same maximum luminance, but with lower contrast. In other words, if two displays are displaying the same image such that each image has the same luminance level, the display exhibiting the higher contrast will appear brighter than the image exhibiting the lower contrast.

Keeping this in mind, the ACL 28 may use the Bartleson-Breneman effect for text-rendering applications and reduce drive currents 48 provided to the subpixels in the display 10. Since the contrast of black text on a white background in OLED displays will be high due to the high levels of black color that OLEDs are able to provide, the reduction in the overall white level of the white background may not significantly detract from a user's reading experience. In one embodiment, the ACL 28 may reduce the drive current provided to the subpixels in the display 10 by some percentage or by some overall amount from an amount of current specified by the respective application for the subpixels. For example, if the contrast between black text and a white background on an OLED display is 1000:1, then reducing the white background luminance (i.e., reducing the drive current provided to the white background subpixels) by 20% (to 80% of the original luminance) may simply reduce the contrast between the black text and the white background to 800:1. In this manner, the user's reading experience may not be significantly affected so long as a sufficient amount of contrast exists between the displayed text and background. By reducing the drive currents 48 provided to the subpixels in the display 10 for text-rendering applications, the ACL 28 may maintain the readability of the displayed text based on the contrast between the displayed black text and the white background while reducing the power being consumed by the display 10.

Instead of reducing the drive current 48 to each subpixel in the display 10, in one embodiment, the ACL 28 may reduce the drive current 48 provided to the subpixels that correspond to the white background. That is, the ACL 28 may reduce the drive current 48 provided to each subpixel that corresponds to a pixel that displays a white color, while maintaining the drive currents 48 for the subpixels that are not used to display a white color.

As mentioned above, when determining the drive current 48, the ACL 28 may reduce the amount of current provided to the subpixels in the display 10 by some percentage or by some overall amount from an amount of current specified by the respective application. In one embodiment, the ACL 28 may reduce the drive currents 48 provided to subpixels that have a luminance level greater than some luminance level limit. For example, if the luminance level limit is 80% of the maximum luminance value, the ACL 28 may reduce the drive currents 48 to the respective subpixels that have a luminance above 80%. In one embodiment, the ACL 28 may reduce the drive currents 48 provided to those respective subpixels by 20% to 80% or by 60% to 80% while maintaining the drive currents 48 provided to subpixels that have a luminance below 80%. In this manner, the ACL 28 may achieve more significant power savings in the display 10 while maintaining a certain level of quality of the images displayed in the display 10.

Instead of reducing the drive currents 48 to the respective subpixels that have a luminance above the luminance level limit by some percentage value, the ACL 28 may reduce the drive currents 48 provided to each respective subpixel that has a luminance above the luminance level limit such that the respective subpixel has a luminance level that corresponds to the luminance level limit. In either case, after calculating the drive currents 48 for each subpixel in the display 10, at block 56, the ACL 28 may send the calculated drive currents 48 to each subpixel in the display 10.

Referring back to block 52, if the application type 42 is directed towards displaying image data 44 that include colorful photographs or videos, at block 54, the ACL 28 may not reduce the drive currents 48 in order to preserve the quality of the image data 44 being displayed. As a result, the ACL 28 may provide the drive currents 48 as specified for each subpixel in the display 10 by the respective application. Otherwise, the ACL 28 may reduce the drive currents 48 applied to each subpixel in the display 10 by a small percentage (e.g., less than 10%) such that the image quality of the displayed image is preserved. In this manner, the ACL 28 may limit or eliminate the amount of current reduction being applied to the calculated drive currents 48 in block 54 for applications in which accurate color and luminance are desirable. That is, the ACL 28 may significantly reduce drive currents 48 for applications types 42 that are intrinsically high in power but display images that are not particularly colorful or detailed. Accordingly, the ACL 28 may enable the display 10 to become more power efficient for application types 42 that do not depict particularly colorful or detailed images, while preserving the image quality of the images depicted in the display 10 for those application types 42 that do depict colorful and detailed images.

Figure 6:
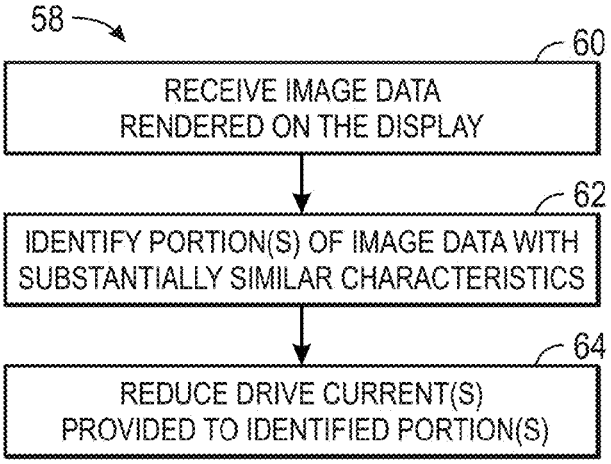
FIG. 6 is a flow chart that depicts a method for reducing an amount of drive currents sent to a display based on an image being rendered on the display, in accordance with an embodiment.

In one embodiment, the ACL 28 may reduce drive currents 48 provided to the display 10 for application types 42 in which images are being displayed according to a method 58 described in FIG. 6. Referring to FIG. 6, at block 60, the ACL 28 may receive image data 44 that include one or more images to be displayed on the display 10. At block 62, the ACL 28 may analyze the image data 44 and identify one or more portions in the displayed image data 44 that have substantially similar characteristics, such as pixels with substantially similar luminance and color values. For example, portions of the image data 44 that have substantially similar luminance or color values may include portions of the image data 44 that include "white" pixels. White pixels may include pixels that meet or exceed a certain luminance level floor and possess a set of color coordinates within a region defined as "white." In addition to white pixels, portions of the image data 44 that have substantially similar luminance or color values may include portions of the image data 44 that include the same bright and solid color.

In one embodiment, the ACL 28 may identify the portions of the image data 44 that have substantially similar characteristics by comparing the luminance and/or color coordinates of a respective pixel with its neighboring pixels. Pixels that are immediately adjacent to the respective pixel may be categorized as part of a first level of proximate pixels. Similarly, pixels that are immediately adjacent to the first level pixels may be categorized as part of a second level of proximate pixels. The ACL 28 may identify the portion of the image data 44 that have substantially similar characteristics based on whether the portion of the image data 44 includes some number of pixels or levels of proximate pixels that have substantially similar luminance and/or color coordinates. For example, the ACL 28 may identify portions of the image data 44 for areas of the image data 44 that include pixels in which the luminance and color coordinates of pixels up to four levels away are substantially the same as the respective pixel.

After identifying the portions of the image data 44 that have substantially similar characteristics, at block 64, the ACL 28 may reduce the drive currents 48 provided to the subpixels that correspond to the portions of the image data 44 identified at block 60. In this manner, the ACL 28 may reduce the luminance in portions of the image data 44 that may be used for background purposes while maintaining the luminance of the images depicted in the image data 44. An example of the effects of reducing the luminance in the portions of image data 44 that are part of the background of the image data 44 is illustrated in FIG. 7.

Figure 7:
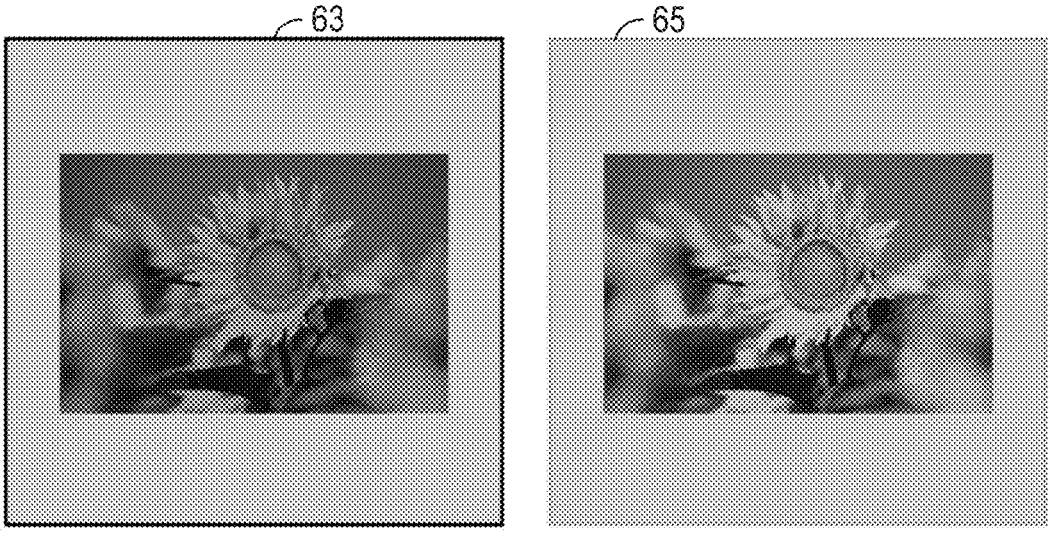
FIG. 7 provides two screen shots illustrating an example of an effect of reducing drive currents sent to a display based on an image being displayed, in accordance with an embodiment.

Referring to FIG. 7, image 63 depicts the results of using a conventional ACL controller to reduce the overall power of the image data 44 uniformly by dimming both the white portions and the color portions of the image data 44. From a power saving viewpoint, reducing the white luminance provides substantial power benefits, but reducing the image luminance provides only marginal power benefits. Moreover, reducing the image luminance decreases the quality of the colors displayed in the image. In general, users may not be concerned with the luminance of the background or frame, but they will be very sensitive to a decrease in the luminance of the colored image.

Keeping this in mind, the ACL 28 may achieve significant power savings while simultaneously providing for accurate luminance and color coordinates for the displayed images by reducing the luminance in just the background portion of the image data 44, as illustrated in image 65 of FIG. 7. Referring back to FIG. 5, after determining the drive currents 48 for the identified portions of the image data 44, at block 56, the ACL 28 may send the calculated drive currents to the display 10.

Figure 8:
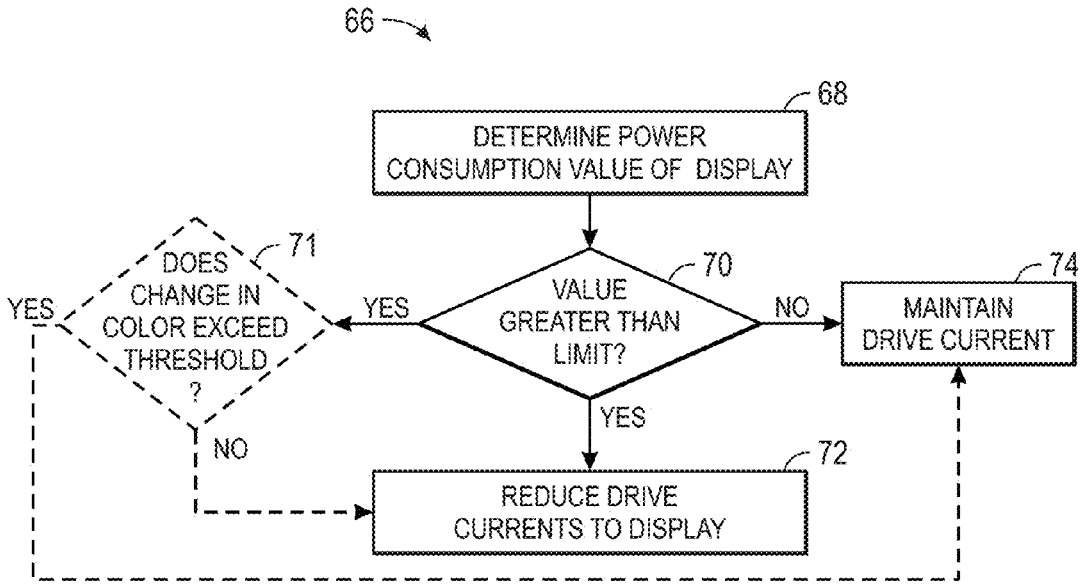
FIG. 8 is a flow chart that depicts a method for reducing drive currents sent to a display based on power consumption properties of the display, in accordance with an embodiment.

In addition to modifying the drive currents 48 based on the application type 42 or the image data 44 rendered on the display 10, the ACL 28 may also modify the drive currents 48 provided to the display 10 based on the power consumption properties 45 of the display 10, as depicted in method 66 of FIG. 8. Referring now to FIG. 8, at block 68, the ACL 28 may determine power consumption properties 45 for the display 10. At block 70, the ACL 28 may determine whether the power consumption properties 45 are greater than some limit. If the power consumption properties 45 are greater than the limit, the ACL 28 may proceed to block 72 and reduce the drive currents 48 to be provided to the display 10. If, however, the power consumption properties 45 are not greater than the limit, the ACL 28 may proceed to block 74 and maintain the drive currents 48 to be provided to the display 10.

In one embodiment, the power consumption properties 45 may be determined based on the luminance and color properties displayed in each pixel in the display 10. In certain devices such as an OLED display, the power consumption properties 45 in generating different colors vary for each color because each individual pixel in an OLED display displays its own color. For example, a blue pixel in an OLED display is generally less power efficient than a green pixel, even if both of these pixels have the same luminance. The difference in efficiency for each color generally depends on an exact material composition and structure of the OLED subpixels (i.e., OLED layer). Similarly, the relative efficiency for white OLEDs with color filters generally depends on color subpixel, due to the OLED material, the OLED design properties, and the optical properties of the color filter. As such, by accounting for both the luminance and color properties of each pixel in the display 10, the ACL 28 may more accurately determine the power consumption properties 45 for the display 10. A method 75 depicting how the power consumption properties 45 may be determined using both the luminance and color properties of each pixel in the display 10 is described in greater detail below with reference to FIG. 9.

Figure 9:
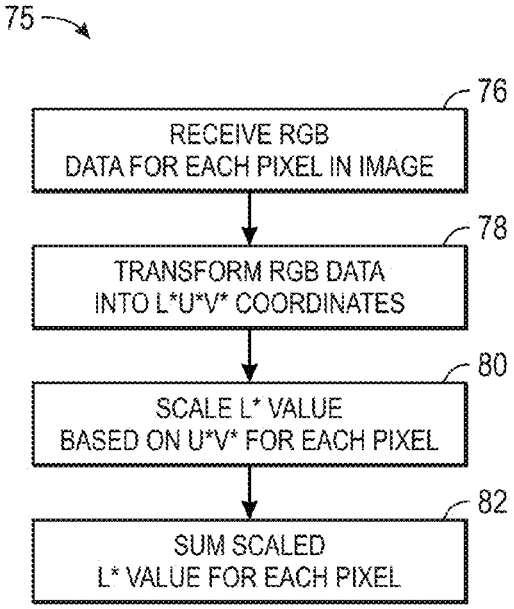
FIG. 9 is a flow chart that depicts a method for reducing drive currents sent to a display based on luminance and color properties of images rendered on the display, in accordance with an embodiment.

Referring to FIG. 9, at block 76, the ACL 28 may receive red, green, and blue color data (RGB data) for each pixel in the display 10. At block 78, the ACL 28 may transform the RGB data into International Commission on Illumination (CIE) 1976 (L*, u*, v*) color space or L*u*v* coordinates.

After transforming the RGB data for each pixel into L*u*v* coordinates, at block 80, the ACL 28 may scale the luminance (L*) value by a factor ($P_{u^*v^*}$) that depends on the corresponding u*v* value. The scaling factor may be used to more accurately characterize the amount of power being consumed by the respective pixel based on the color that the respective pixel is displaying.

At block 82, the ACL 28 may sum the scaled luminance value (L*x $P_{u^*v^*}$) for each pixel in the display 10. Referring back to block 70 in FIG. 8, the ACL 28 may then compare the sum (i.e., power consumption value) to some limit. If the sum is greater than the limit, the ACL 28 may proceed to block 72 and reduce the drive currents 48 provided to each subpixel in the display 10, as described above. Alternatively, if the sum is not greater than the limit, the ACL 28 may proceed to block 74 and maintain the drive currents 48 as specified by the corresponding application.

In one embodiment, the ACL 28 may forego block 78 and apply scaling factors for each pixel at block 80 to each corresponding subpixel. That is, the individual RGB values for each pixel may be multiplied by an appropriate scaling factor (e.g., $P_R$, $P_G$, $P_B$), which may be stored in a lookup table, and the resulting products may be summed together to determine the power consumption properties 45 of the display 10. As such, the power consumption properties 45 for the display 10 may be calculated by summing the values of $R\times P_R$, $G\times P_G$, and $B\times P_B$ for all of the subpixels in the display 10. The scaling factor ($P_R$, $P_G$, $P_B$) may represent a value that is proportional to the amount of power that would be consumed in driving a respective subpixel to its respective red, green, or blue value. After summing the values of $R\times P_R$, $G\times P_G$, and $B\times P_B$ for all of the subpixels in the display 10, the ACL 28 may proceed to block 70 of method 66 and determine whether the sum is greater than the limit.

If the sum is greater than the limit, at block 72, the ACL 28 may reduce the drive currents 48 provided to each respective pixel such that each respective pixel may have RGB values at some threshold. For instance, the ACL 28 may compare the red, green, and blue digital levels (e.g., 0 to 255 for an 8-bit subpixel) for corresponding red, green, and blue subpixels in each pixel in the portion of the image data 44 to the threshold. If the red, green, or blue subpixel in each pixel of the portion of the image data 44 has a digital level above the threshold, the ACL 28 may reduce the drive current 48 provided to each of the corresponding subpixels to the threshold. In one embodiment, the ACL 28 may reduce the drive currents 48 as described above only if each of the three subpixels in the respective pixel is below the threshold to prevent any change to occur in tinted background colors.

In certain situations, a change in color in a portion of the display 10 may cause the sum to exceed the limit at block 70 and may cause the ACL 28 to reduce the drive currents 48 provided to the display 10 at block 72. For instance, if a large portion of the display 10 changes from green to blue, and since blue emission uses more power than green emission, then the power consumption properties 45 for the display 10 will increase due to the increased current consumption that corresponds to blue pixels in OLED displays. In this case, if a different portion of the same display 10 is held constant while the other portion changes color from green to blue, then the change in color could lead to an overall reduction in the drive currents 48 applied to all of the display 10, which will change the portion of the display 10 intended to remain constant. As a result, a user viewing the images depicted on the display 10 may be disappointed in the quality of the images depicted in the display 10. For example, if most of the content depicted in the display 10 changes from a dark image to a light image, then a user will likely not notice a reduction in the brightness of the light image as a power-saving measure. However, if only part of an image changes in brightness and other portions of the image are unchanged, then the user may object to any significant change in the brightness of the portion of the image that is intended to remain constant. In this case, the ACL 28 may override the method 66 described above and keep the applied current at a previous level until there is a significant change in the displayed content. Alternatively, the ACL 28 may implement the current reduction gradually over a period of time, so that the user does not notice a distinct change in the image brightness. For instance, the current reduction may occur in a series of small steps over a period of one to ten seconds, so that the change is barely noticeable to the viewer.

At block 71, the ACL 28 may perform an optional process that determines whether a change in the colors or color intensities of the images depicted in the display 10 exceeds a certain threshold. If the colors of the images do indeed change such that the amount of change exceeds the threshold, the ACL 28 may proceed to block 74 and maintain the drive currents 48 as specified. However, if the colors of the images do not change such that the amount of change does not exceed the threshold, the ACL 28 may proceed to block 72 and reduce the drive currents 48 as described above. In this manner, the ACL 28 may avoid changing the drive current 48 provided to each subpixel in the display 10 when the power consumption value becomes greater than the limit due to a change the color of a portion of the display 10 but not due to a change in the luminance of the display 10.

Although method 75 has been described for OLED displays equipped with RGB color filters, it should be noted that in certain embodiments method 75 may also be performed for OLED displays equipped with RGBW color filters. In this case, after the ACL 28 receives the RGB data for each pixel in the display 10 at block 76, the ACL 28 may convert the RGB data into a RGBW data and the remaining steps of method 75 may be performed based on the RGBW data.

Figure 10:
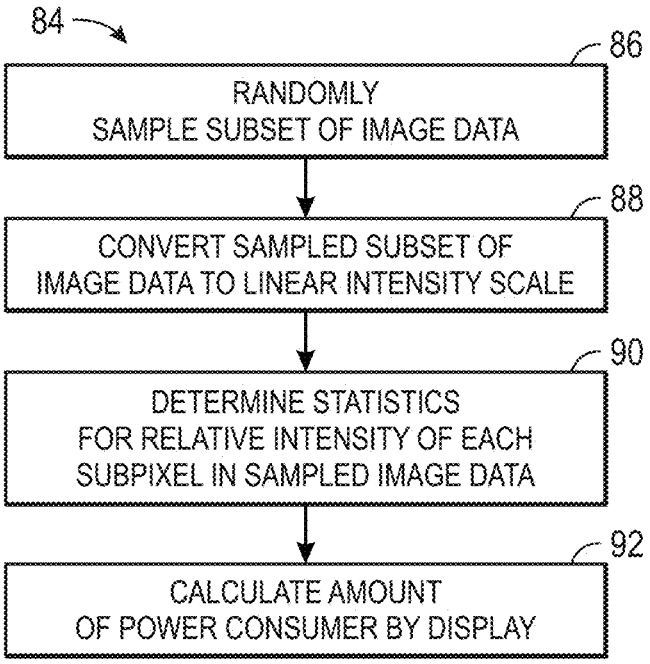
FIG. 10 is a flow chart that depicts a method for determining an estimate of luminance of a display using a sampling algorithm, in accordance with an embodiment.
Figure 11:
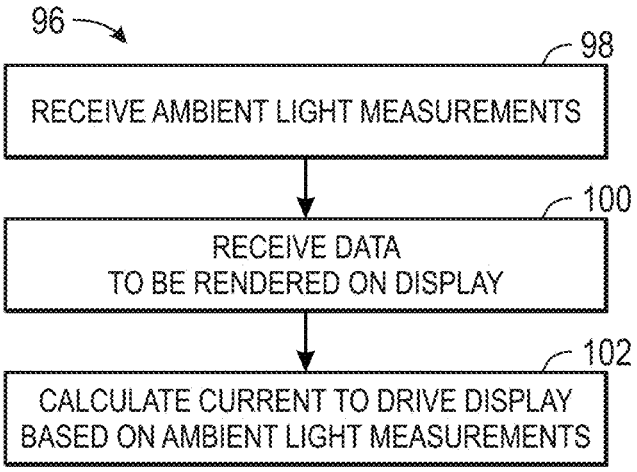
FIG. 11 is a flow chart that depicts a method for reducing drive currents sent to a display based on present ambient light conditions, in accordance with an embodiment.

For high pixel count displays, performing method 75 may involve a significant amount of processing time and power. To alleviate the amount of processing time and power used to perform method 75, the ACL 28 may randomly sample a subset of all the pixels in the display 10 and determine an estimate of the luminance of the overall display 10 based on the sample. For instance, FIG. 10 illustrates a method 84 for determining an estimate of luminance of the display 10 using a sampling algorithm. To improve accuracy, the ACL 28 may divide the display 10 into a number of fixed areas across the display area. The ACL 28 may then randomly sample one or more pixels in each fixed area to better insure that the current reduction is representative of images shown across the entire screen. For example, the display 10 may be divided into 64 rectangles of uniform height and an equal or a different uniform width, spaced uniformly across the display. The ACL 28 may then perform the pixel sampling within each of these designated rectangles.

Referring now to FIG. 10, at block 86, the ACL 28 may sample a fraction or subset of the image data 44 to be depicted on the display 10. At block 88, the ACL 28 may convert the sampled image data to a linear intensity scale by, for example, applying a digamma function. Using the linear intensity scale, at block 90, the ACL 28 may determine statistics for the relative intensity of each subpixel in the sampled image data. At block 92, the ACL 28 may then use the statistics to calculate an amount of power being consumed by the display 10. The ACL 28 may then compare this calculated power value to the limit as described in block 70 and proceed to block 72, block 71, or block 74 depending on whether the calculated power value is greater than the limit.

For each of the methods described above (i.e., method 50, 58, 75, or 84), if a portion of the display 10 changes rapidly between frames of data, the ACL 28 may provide rapidly fluctuating drive currents 48 to the pixels of the display 10, thereby causing a flicker effect or other visual artifacts to be depicted on the display 10. To prevent these types of visual artifacts, the methods described above may be modified such that the ACL 28 may not be allowed to change the drive currents 48 more than once during some period of time. For example, in method 66, the ACL 28 may not be allowed to change the drive currents 48 at block 72 more than once in a five second period.

Referring back to FIG. 4, in addition to the application type 42, the image data 44, and the power consumption properties 45, the ACL 28 may use ambient light measurements 46 to determine the drive currents 48 for each subpixel in the display 10. The ambient light measurements 46 may be acquired from the light sensors 22, described above, and may indicate the overall illumination level impinging on the light sensors 22. In general, the ambient light measurements 46 may indicate whether the device is outdoors or indoors. In one embodiment, the ACL 28 may adjust the drive currents 48 provided to the display 10 based on the ambient light measurements 46 according to a method 96 described below with reference to FIG. 11.

At block 98, the ACL 28 may receive ambient light measurements 46 from the light sensors 22. At block 100, the ACL 28 may receive data pertaining to images that are to be rendered on the display 10. At block 102, the ACL 28 may calculate drive currents 48 for each subpixel in the display 10 based on the ambient light measurements 46. In one embodiment, if the ambient light measurements 46 are greater than some threshold, the ACL 28 may reduce the drive currents 48 provided to the display 10. In this manner, for high ambient light measurements 46, the ACL 28 may implement a different set of drive currents 48 as compared to lower ambient light measurements 46.

In one embodiment, the ACL 28 may calculate the drive currents 48 based on the application type 42, the image data 44, the power consumption properties 45, the ambient light measurements 46, or any combination of these inputs. For example, if the ACL 28 receives ambient light measurements 46 that are greater than the threshold (e.g., outdoor usage) and an application type 42 that corresponds to a text-rendering application, the ACL 28 may increase the luminance of the entire display 10 to enable a user to more easily view the depicted text in the display 10. If, however, the ACL 28 receives ambient light measurements 46 that are greater than the threshold (e.g., outdoor usage) and an application type 42 that corresponds to an image-rendering application, the ACL 28 may provide drive currents 46 to the display 10 based on the amount of white color being depicted in the display 10. Here, the ACL 28 may reduce the drive currents 48 a greater amount for images that have a large portion of white depicted in the display 10 as compared to the images that have a small portion of white depicted in the display 10.

By employing the methods described herein, the ACL 28 may provide greater power savings for the display 10 and avoid generating high levels of heat in the display 10, which may damage various components in the display 10. Further, a user may experience a more satisfactory viewing experience on the display 10 while the display 10 employs various power consumption savings techniques.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

receiving a first set of color data associated with one or more subpixels in a display for a first frame of image data;

receiving a second set of color data associated with the one or more subpixels in the display for a second frame of image data;

determining a difference between the first set of color data and the second set of color data;

determining an estimate that corresponds to power consumption of at least a portion the display based on the second set of color data;

reducing one or more drive current values that corresponds to at least a portion of the second frame of image data in response to determining that the estimate exceeds a first threshold and determining that the difference is less than a second threshold; and supplying at least a portion of the one or more subpixels associated with the at least the portion of the second frame of image data with the reduced drive current values.

2. The method of claim 1, wherein the estimate is determined by:

transforming red, green, and blue (RBG) data for each subpixel of the one or more subpixels in the second frame of image data into L*u*v* coordinates;

scaling each L* value for each pixel by a factor based at least in part on a respective u*v* value; and summing the scaled L* value for each subpixel.

3. The method of claim 1, wherein the one or more drive current values is reduced by a percentage between 20% and 80%.

4. The method of claim 1, wherein the one or more drive current values is reduced over a period of time in accordance with a step function.

5. The method of claim 1, comprising not reducing the one or more drive current values in response to the estimate being lower than the first threshold.

6. The method of claim 1, comprising not reducing the one or more drive current values in response to the difference being greater than the second threshold.

7. The method of claim 1, wherein the first set of color data comprises color coordinate data.

8. A system comprising:

a display comprising one or more subpixels;

an automatic current limiting (ACL) controller configured to:

receive a first set of color data associated with the one or more subpixels in the display for a first frame of image data;

receive a second set of color data associated with the one or more subpixels in the display for a second frame of image data;

determine a difference between the first set of color data and the second set of color data;

determine an estimate that corresponds to power consumption of at least a portion of the display based on the second set of color data;

reduce one or more drive current values that corresponds to at least a portion of the second frame of the image data in response to determining that the estimate exceeds a first threshold and determining that the difference is less than a second threshold; and supply at least a portion of the one or more subpixels associated with the at least the portion of the image data with the reduced drive current values.

9. The system of claim 8, wherein the ACL controller is configured to determine the estimate based on a random sample of a subset of the second set of color data.

10. The system of claim 8, wherein the ACL controller is configured to determine the estimate by:

dividing the display into a number of fixed areas;

randomly sample at least one subpixel in each of the number of fixed areas;

convert a sample of the at least one subpixel in each of the number of fixed areas to a linear intensity scale; and determining the estimate based on the converted sample of the at least one subpixel in each of the number of fixed areas.

11. The system of claim 10, wherein the sample of the at least one subpixel in each of the number of fixed areas is converted to the linear intensity scale based on digamma function.

12. The system of claim 8, wherein the ACL controller is configured to reduce the one or more drive current values that corresponds to at least the portion of the image data one time over a period of time.

13. The system of claim 12, wherein the period of time comprises five seconds.

14. The system of claim 8, wherein the ACL controller is configured to:

identify a portion of image data comprising a plurality of pixels having substantially uniform luminance and substantially uniform color coordinates;

reduce at least some of the drive current values that corresponds to the portion of the image data.

15. A system comprising:

a display device comprising one or more subpixels;

an automatic current limiting (ACL) controller configured to:

receive drive current values associated with the one or more subpixels in the display device;

determine a power consumption value for the display device based on the drive current values;

reduce the drive current values in response to determining that the power consumption data exceeds a power consumption threshold and determining that a change in color intensities corresponding to the one or more subpixels is lower than a color intensity threshold; and supply the one or more subpixels with the reduced drive current values.

16. The system of claim 15, wherein the ACL is configured to determine the power consumption based on L*u*v* coordinates assocaited with the subpixels.

17. The system of claim 15, wherein the ACL is configured to determine the power consumption based on color data associated with the subpixels.

18. The system of claim 15, wherein the ACL is configured to determine the power consumption based on a random sample of color data associated with the subpixels.

19. The system of claim 15, wherein the ACL is configured to reduce the drive current values in response to ambient light measurements acquired by one or more sensors on the display device.

20. The system of claim 15, wherein the ACL is configured to reduce the drive current values in response to an application being presented by the display device.

* * * * *